US010670202B2

(12) United States Patent
Ganahl

(10) Patent No.: US 10,670,202 B2
(45) Date of Patent: Jun. 2, 2020

(54) MULTIBEAM LIGHTING SYSTEM

(71) Applicant: Joseph Ganahl, Honolulu, HI (US)

(72) Inventor: Joseph Ganahl, Honolulu, HI (US)

( * ) Notice: Subject to any disclaimer, the term of this patent is extended or adjusted under 35 U.S.C. 154(b) by 0 days.

(21) Appl. No.: 16/440,625

(22) Filed: Jun. 13, 2019

(65) Prior Publication Data

US 2020/0003371 A1 Jan. 2, 2020

Related U.S. Application Data

(63) Continuation of application No. 16/024,871, filed on Jul. 1, 2018, now Pat. No. 10,344,924.

(51) Int. Cl.

| | |
|---|---|
| ***F21V 21/088*** | (2006.01) |
| ***F21L 4/08*** | (2006.01) |
| ***F21V 31/00*** | (2006.01) |
| ***F21V 15/04*** | (2006.01) |
| ***F21V 23/00*** | (2015.01) |
| ***F21V 23/04*** | (2006.01) |
| ***F21V 21/08*** | (2006.01) |
| ***F21V 23/02*** | (2006.01) |
| ***F21L 4/02*** | (2006.01) |

(Continued)

(52) U.S. Cl.

CPC ..... *F21L 4/08* (2013.01); *B63B 45/00* (2013.01); *F21L 4/02* (2013.01); *F21S 9/037* (2013.01); *F21V 15/04* (2013.01); *F21V 21/08* (2013.01); *F21V 21/0885* (2013.01); *F21V 21/32* (2013.01); *F21V 23/003* (2013.01); *F21V 23/023* (2013.01); *F21V 23/0435* (2013.01); *F21V 23/0471* (2013.01); *F21V 31/005* (2013.01); *F21V 33/0052* (2013.01); *F21Y 2115/10* (2016.08)

(58) Field of Classification Search

CPC ..... F21L 4/08; F21L 4/02; F21V 21/0885; F21V 21/32; F21V 33/0052; F21V 31/005; F21V 15/04; F21V 23/003; F21V 23/0435; F21V 21/08; F21V 23/0471; F21V 23/023; F21S 9/037; B63B 45/00; F21Y 2115/10; B63C 11/26; B63C 2011/021

See application file for complete search history.

(56) References Cited

U.S. PATENT DOCUMENTS 3,830,230 A * 8/1974 Chester ..... F21V 21/145 600/249
4,788,631 A ‡ 11/1988 Fuller ..... F21V 9/083 362/103

(Continued)

*Primary Examiner* — Donald L Raleigh

(57) ABSTRACT

The embodiments disclose a lighting device configured for projecting at least a 180 degree halo of light using at least one component module having a LED/lens light pod module, a mount configured for a user to wear the lighting device on a user's hand, at least one external battery pack and a navigation light device with the lighting device, wherein the lighting device and the navigation light device are configured to project a 360 degree light pattern and at least one sensor configured to automatically activate a front LED/lens light pod module when the user raises and points a hand to gain a predetermined distance forward focused beam in a pointing direction, wherein the at least one sensor activates left and right side LED/lens light pod modules for projecting a light pattern to a front and rear direction when the user's arm is at one's side.

20 Claims, 17 Drawing Sheets

(51) Int. Cl.

| | |
|---|---|
| ***F21V 21/32*** | (2006.01) |
| ***F21S 9/03*** | (2006.01) |
| ***F21V 33/00*** | (2006.01) |
| ***B63B 45/00*** | (2006.01) |
| *F21Y 115/10* | (2016.01) |

(56) References Cited

U.S. PATENT DOCUMENTS 5,191,197 A ‡ 3/1993 Metlitsky ..... G06K 7/10564 235/462.44
6,213,619 B1 ‡ 4/2001 Yu ..... A45F 5/02 116/DIG. 44
6,550,930 B1 ‡ 4/2003 Portouche ..... F21L 4/00 362/103
8,398,255 B2 ‡ 3/2013 Starogiannis ..... F21L 4/04 2/160
9,091,428 B2 * 7/2015 Ferguson ..... A61B 90/35
9,155,168 B2 ‡ 10/2015 Araujo ..... F21V 23/0492
2008/0027674 A1 * 1/2008 Sandy ..... F21L 4/027 702/160
2011/0182057 A1 ‡ 7/2011 Watson ..... B23B 45/00 362/103
2011/0261556 A1 * 10/2011 Gibson ..... F21V 21/084 362/105
2012/0081884 A1 ‡ 4/2012 Gonzalez ..... F21L 4/00 362/103
2012/0120635 A1 * 5/2012 Strong ..... F21V 21/084 362/105
2013/0250593 A1 * 9/2013 Popper ..... F21V 21/084 362/476
2014/0043794 A1 * 2/2014 Carriere ..... F21V 33/0008 362/103
2014/0198484 A1 * 7/2014 Feustel ..... F21V 23/0464 362/105
2014/0285355 A1 * 9/2014 Matte ..... F21V 21/0965 340/815.45
2015/0016094 A1 * 1/2015 Yamai ..... F21V 21/084 362/105
2016/0140870 A1 ‡ 5/2016 Connor ..... G09B 19/0092 356/51
2017/0023222 A1 * 1/2017 Lee ..... F21V 23/0492
2017/0055328 A1 ‡ 2/2017 Law ..... F21V 21/084
2017/0135178 A1 * 5/2017 Sutton ..... A43B 3/102
2017/0363258 A1 * 12/2017 Tolley ..... A41D 19/0024
2017/0364156 A1 ‡ 12/2017 Kim ..... G06F 3/016
2018/0000205 A1 * 1/2018 Chinowsky ..... F21V 33/0008
2018/0100646 A1 * 4/2018 Sullivan ..... A41D 13/01
2018/0110280 A1 * 4/2018 Patel ..... F21L 4/085
2018/0376561 A1 * 12/2018 Pham ..... F21V 23/0471
2019/0166933 A1 * 6/2019 Tiffin ..... A41D 19/0024
2019/0216144 A1 * 7/2019 York ..... F21V 21/14

* cited by examiner
‡ imported from a related application

MULTIBEAM LIGHTING SYSTEM

This Application is based on U.S. Non-Provisional patent application Ser. No. 16/024,871 filed on Jul. 1, 2018, entitled "MULTIBEAM LIGHTING SYSTEM", by Joseph Ganahl.

FIELD OF THE INVENTION

The present invention relates to hand portable light systems. More specifically, this invention describes an ergonomic, rugged, compact, portable apparatus and method for a structure which encloses multiple LED/Lens pods along with a battery. The invention creates multi directional and/or at least a 180 degree light patterns, resembling a halo like circular light, with a lightweight, wearable and mountable system.

BACKGROUND OF THE INVENTION

Hand Portable light systems are utilized by a wide range of people, for many different functions, in many different locations and circumstances. Current solutions are limited in beam angle, robustness and ease of use/portability. As usage of hand portable light systems continues to increase, so too does the need to easily deploy them, provide enhanced operational power and offer a greater range of usage flexibility. Additionally, due to electronic design of LED lights, more durable solutions are needed to withstand the rigors of everyday usage. Accordingly, it is an object of the subject invention to implement such method through a relatively simple device that will allow for low cost production and compact size to maximize adoption and usage.

It is another object of the subject invention to provide a reliable and effective method of shock-proofing the hand portable light systems. It is a further object of the subject invention to provide a method and device for creation of a wide range of beam angles. It is a further object of the subject invention to provide a method and device suitable for fully adjustable brightness control, of each lens LED pod independently, via a combined Power/Brite control system. It is an additional object of the subject invention to provide USB connectivity for charging the internal battery and input from external battery packs, which can be connected in a daisy chain system, for additional power requirements. It is a further object of the subject invention to provide a method and device with multiple mounting parameters to allow use with a wide range of other devices and body mounting options.

DETAILED DESCRIPTION OF THE INVENTION

In a following description, reference is made to the accompanying drawings, which form a part hereof, and in which is shown by way of illustration a specific example in which the invention may be practiced. It is to be understood that other embodiments may be utilized and structural changes may be made without departing from the scope of the embodiments.

General Overview:

It should be noted that the descriptions that follow, for example, in terms of apparatus and method for a wearable light system, with at least 180 degrees of lighting and light patterns resembling a halo like circular light. The wearable lighting system is described for illustrative purposes and the underlying system can apply to any number and multiple types lighting applications. In one embodiment of the present invention, the apparatus and method for wearable halo lighting system can be configured using an apparatus worn on a user's hand. The apparatus and method for wearable halo lighting system can be configured to include an apparatus mounted on a flexible support and can be configured to include an apparatus mounted on a fixed mounting using the embodiments.

Figure 1:
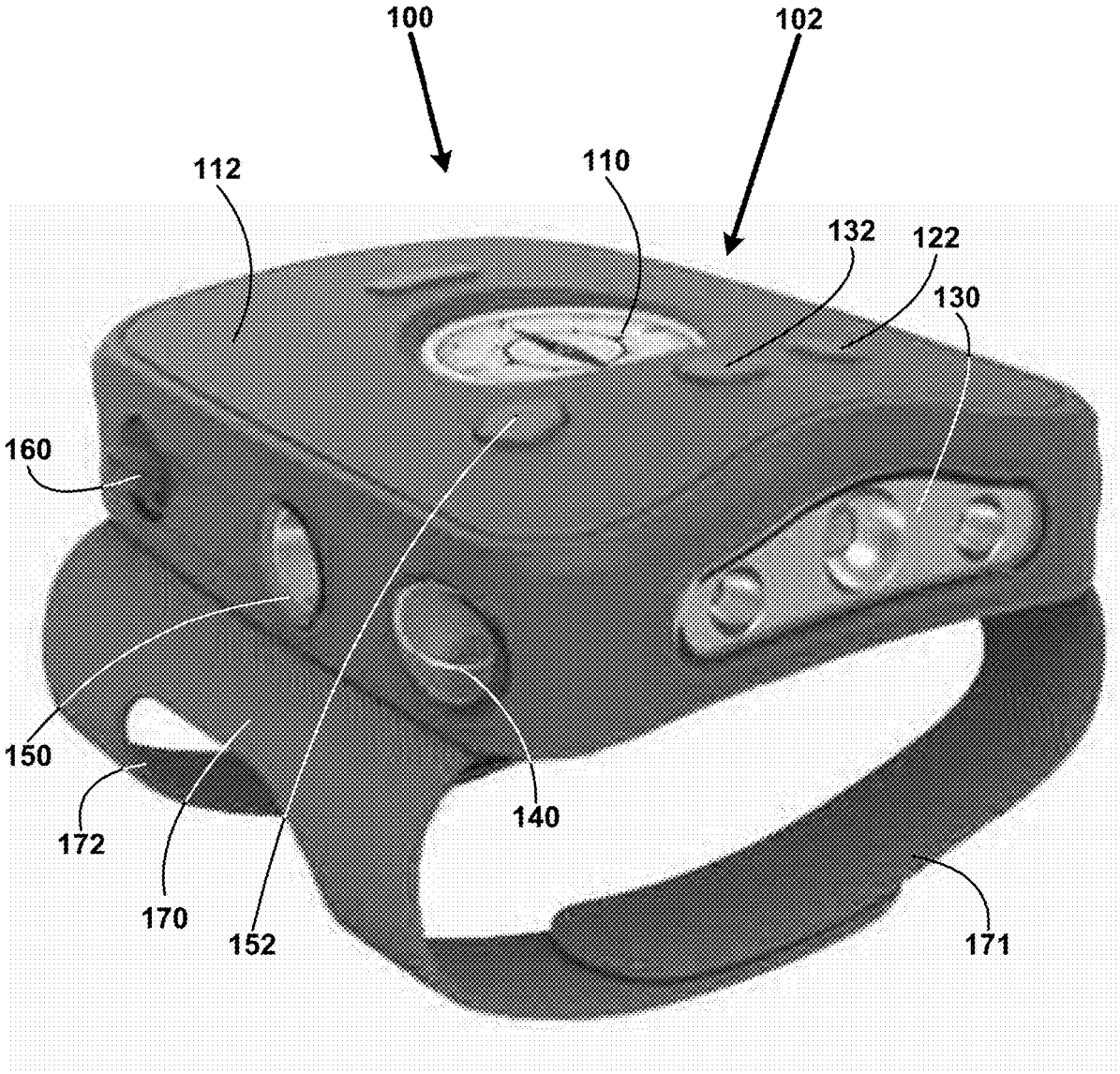
FIG. 1 shows for illustrative purposes an example of a first wearable halo lighting system embodiment right front view perspective of one embodiment.

Wearable Halo Lighting System:

FIG. 1 shows for illustrative purposes an example of a wearable halo lighting system of one embodiment. FIG. 1 shows a wearable halo lighting system 100 in a right front view perspective. The wearable halo lighting system 100 includes a first wearable halo lighting system embodiment 102. The wearable halo lighting system 100 embodiments can include at least one component module including an integrated compass 110, a waterproof case 112, a left side LED/lens light pod control button 122, a left side LED/lens light pod 250 not shown, a front LED/lens light pod 130, a front LED/lens light pod control button 132, a right side LED/lens light pod 150, a right side LED/lens light pod control button 152, a charger/external battery waterproof connection 160, and a removable hand band 170 including a front hand band strap 171 and a rear hand band strap 172, wherein a user's thumb is positioned between the front and rear hand band straps.

LED/lens light pod modules can include at least one component including brightness controls, independent strobe mode selectors, and LED/lens light pod modules can include automatic dim/turn off controls wherein auto dimming is for heat control wherein if heat gets too high it will auto dim to aid cooling. The wearable halo lighting system 100 can be worn on a user's hand using the removable hand band 170 for body wear with an ergonomic comfortable design. The wearable halo lighting system 100 can be configured with a shock resistant electronic mounting.

The wearable halo lighting system 100 can be made in two sizes. A first size is referred to herein as a HALO design with 3 LED pods and 5 lights and lenses. A second size is 50% smaller than the HALO design and referred to herein as an ECLIPSE design with 3 LED pods and 3 lights and lenses. The wearable halo lighting system 100 lights can include 1000 lumen CREE XPI LEDs. The wearable halo lighting system 100 lenses can include multiple beam angles including 0, 45, 90, 180, 225 degrees with direction adjustable LED ports. The wearable halo lighting system 100 can be configured to include multiple mounting alternative including for example ¼ inch 20 threads per inch sockets for mounting on a helmet, bike, tent, tree, or table. The wearable halo lighting system 100 can include a power management system comprising built in cells, extra battery packs that can be worn on arm or attached to gear, modules for multiple operating modes including on, off, standby, run, and, stun and power source routing that includes auto power input detection with an external power priority. The power management system further includes modules for example a battery meter that can be monitored remotely, power bank function module, individual light dial brightness and strobe pod control, individual power controls and auto heat dimming. The wearable halo lighting system 100 can be configured to include a waterproof casing including control buttons, at least one 2-way USB connection, a gas release valve, a clip on diffuser and light filters and an integral heat sink. The wearable halo lighting system 100 can be configured to include remote controls with panic, motion sensor, one touch On, GPS, emergency SMS, blinking light signaling output, and an emergency locator.

The wearable halo lighting system 100 can be used for underwater diving applications and include a protective waterproof housing down to 300 feet in depth below the water surface, Hands Free operation, 180 degree Halo of light, Selectable brightness, Gas release valve, wearable external battery packs that can mount on a user's arm and can be daisy chained with additional battery packs, a spear gun mount with one touch remote trigger, helmet or head gear mount, shock resistant construction, a underwater compass and power bank and a magnet and/or clamp mount for commercial use of one embodiment.

The wearable halo lighting system 100 can be used for camping applications and include a snap on diffuser for a soft light bulb effect with a widely diffused beam, waterproof construction to protect the system if left out in a rain or it falls in a puddle or body of water, remote-control on/off and brightness without a user leaving a sleeping bag, a motion sensor and supporting mount for out of doors placements, an auto trigger element to turn on lights and provide an audio and/or light signally alert should nocturnal visitors arrive, shock resistant construction, a power bank function for recharging cameras, phones and other user devices, integrated solar charging, alternative lighting support methods including removing a hand-strap band, clipping on a diffuser, and stand on table for area lighting. The wearable halo lighting system 100 can be mounted on a tent pole for internal tent lighting, can be attached to a tree for external lighting or latrine guide lighting, an over the shoulder chair attachment for reading and a table clamp for food preparation and a work light of one embodiment.

The wearable halo lighting system 100 can be used for hiking applications including it is comfortable to wear, provides hands free operations, provides a unique walking beam when arms are at one's side, the right and left side LED/lens light pods illuminate near ground towards the front and rear of the user and a user can activate both side pods for forward and rear illumination on group hikes. A user can raise their hand to automatically activate the front LED/lens light pod 130 to gain a predetermined distance forward focused beam in a pointing direction when the user points their hand. This predetermined distance can be a long distance forward focused beam (over 5 meters) that is dependent on the beam angle, the strength of the LED/lens light pod 130 and other things, such as the power provided, the focus of the beam and the like. The long distance range can be projected over many meters and seen over a mile away.

In one embodiment an automatic switch can be integrated into the wearable halo lighting system 100 to illuminate the long distance focused beam when arm is raised for hiking beam adjustment. A hiking user can use the integrated compass 110 to find a destination and record direction and time intervals to prevent getting lost. Waterproof and shock resistant construction prevent damage from water and dropping. The wearable halo lighting system 100 can be configured with a GPS location module, emergency SMS, and an emergency locator which broadcasts the user's GPS coordinates and identification codes over a universal distress frequency for example should a user get lost or injured while hiking. A user's identification codes can be recorded in a master database digital file upon purchase of one embodiment.

The wearable halo lighting system 100 can be used for marine applications including kayaking. The wearable halo lighting system 100 can be used for marine applications include Hands Free operations, includes support modules that are Mountable to pulpit rail, track or other vessel structure, include 180 degree beam angle for steering light, Red/Green side pod filters for navigation light, 360 degree visible filter for anchor/navigation light, Diffuser for working light for example checking a map, includes a Green filter for fish attraction, Remote control functionality, and Shock resistant construction of one embodiment.

The wearable halo lighting system 100 can be used for Tactical operations with alternative modified versions including infrared for customized Tactical operations applications of one embodiment.

DETAILED DESCRIPTION

Figure 2:
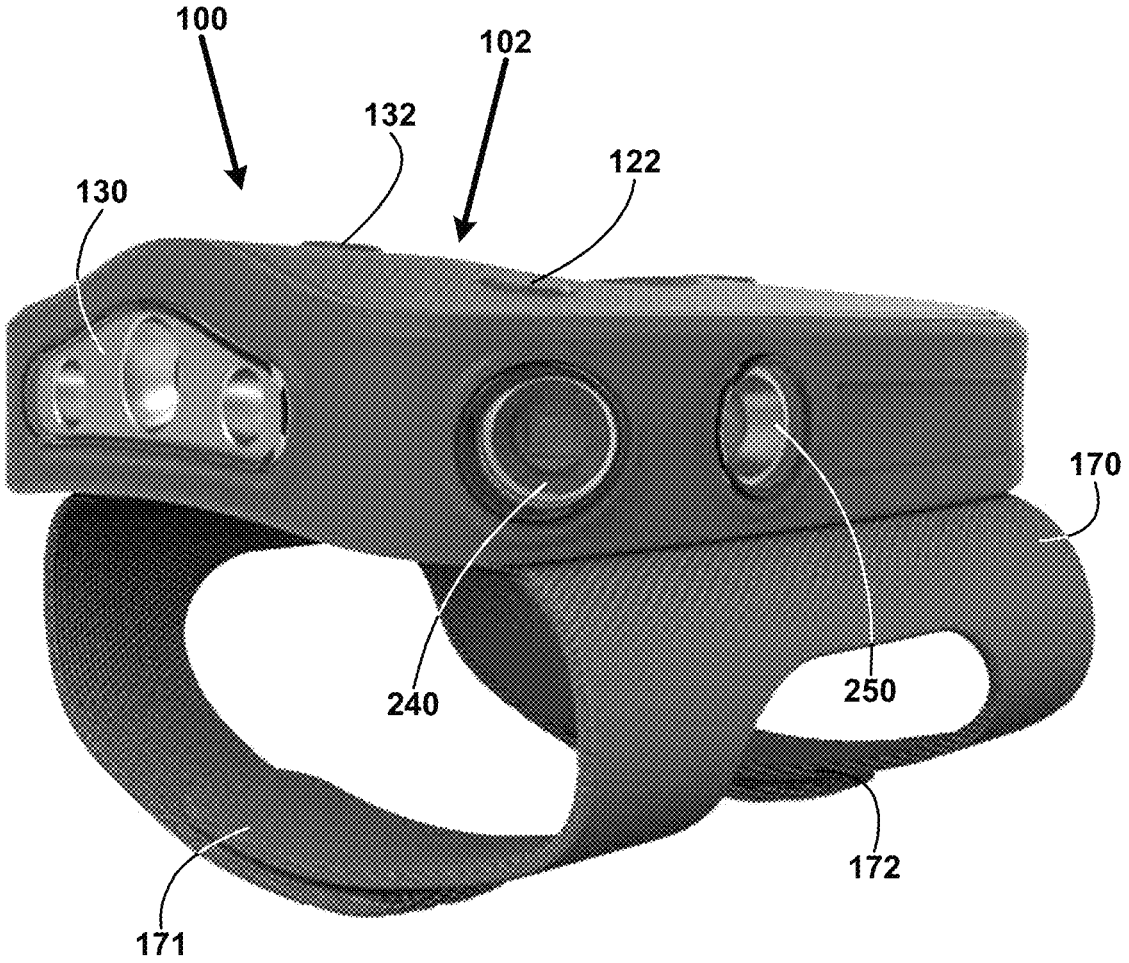
FIG. 2 shows for illustrative purposes an example of a wearable halo lighting system left front view perspective of one embodiment.

FIG. 2 shows for illustrative purposes an example of a wearable halo lighting system left front view perspective of one embodiment. FIG. 2 shows a wearable halo lighting system 100 in a left front perspective view. In this view the wearable halo lighting system 100 shows the left LED/lens light pod control button 122, front LED/lens light pod control button 132, right side LED/lens light pod control button 152, front arm band strap 171, rear arm band strap 172, arm band 170, a left side LED/lens light pod 250, and a left side sensor/detector module including a photo detector sensor and a motion detector 240 of one embodiment.

Figure 3:
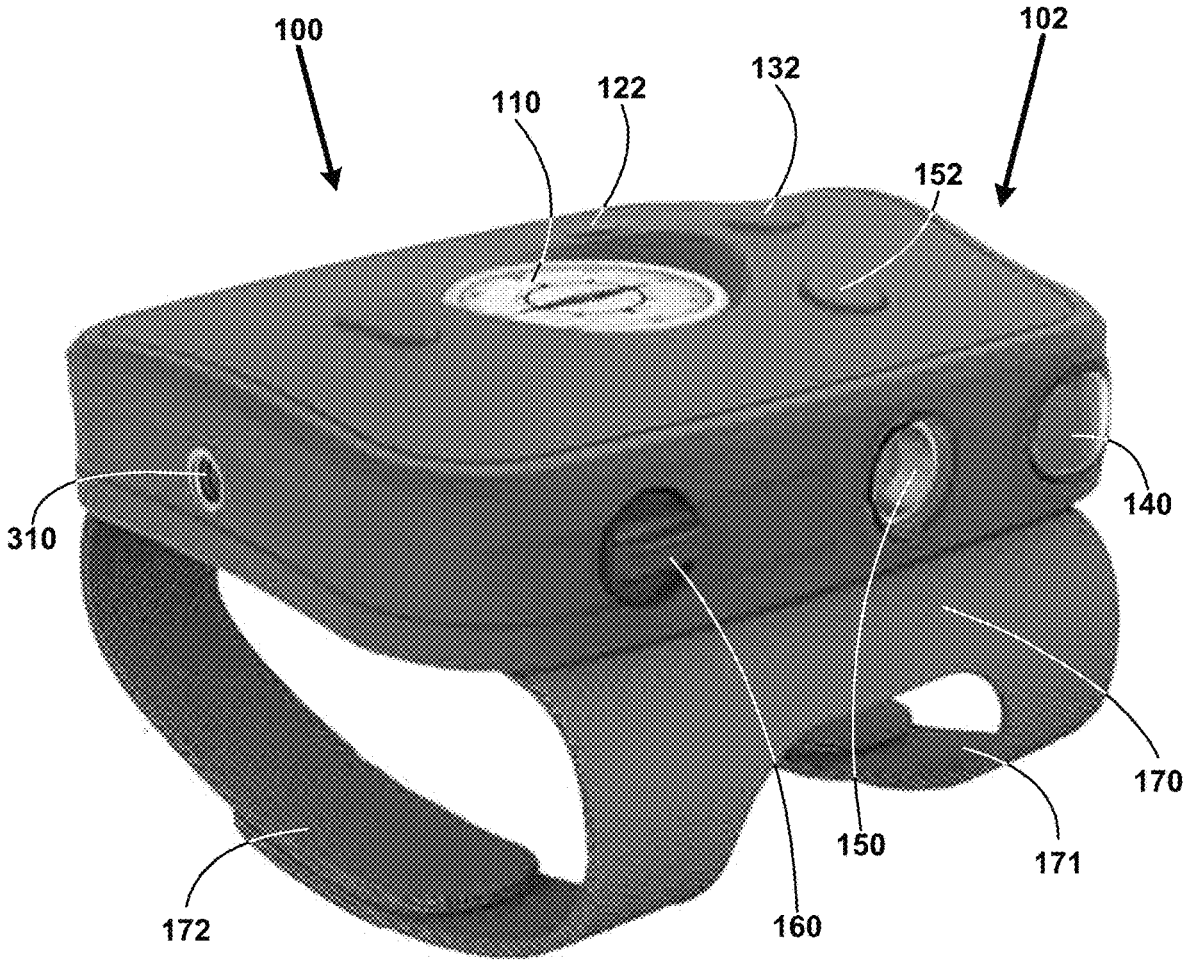
FIG. 3 shows for illustrative purposes an example of a wearable halo lighting system right rear view perspective of one embodiment.

A Wearable Halo Lighting System Right Rear View Perspective:

FIG. 3 shows for illustrative purposes an example of a wearable halo lighting system right rear view perspective of one embodiment. FIG. 3 shows a wearable halo lighting system 100 in a right rear view perspective. In this view can be seen the integrated compass 110, left front light control button 122, center front LED/lens light pod control button 132, right side LED/lens light pod control button 152, right side sensor/detector module 140, charger/external battery waterproof connection 160, back arm band 260, right side LED/lens light pod 150, and an accessories mounting rear socket 310 of one embodiment.

Figure 4:
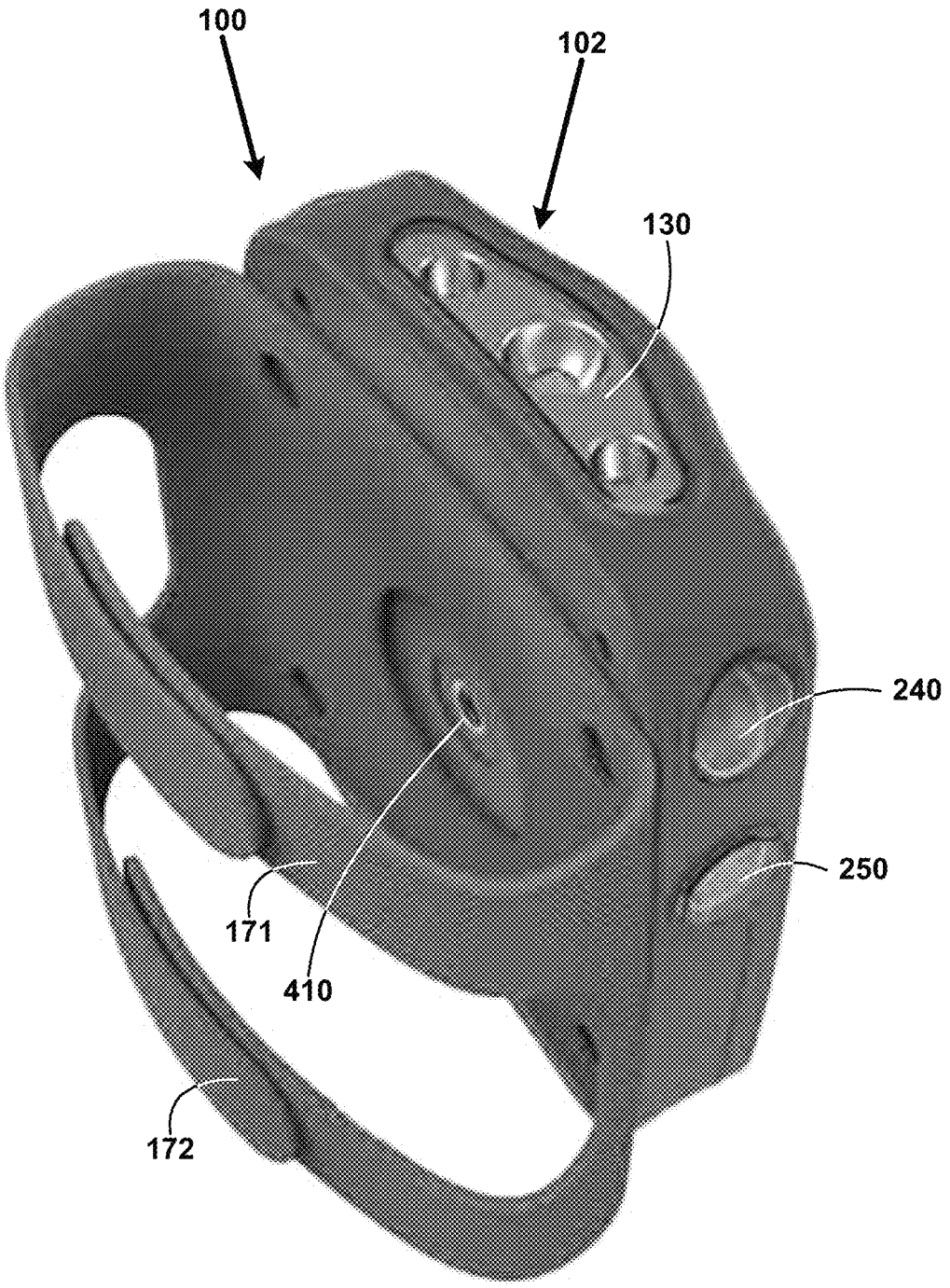
FIG. 4 shows for illustrative purposes an example of a wearable halo lighting system front underneath view perspective of one embodiment.

A Wearable Halo Lighting System Front Underneath View Perspective:

FIG. 4 shows for illustrative purposes an example of a wearable halo lighting system front underneath view perspective of one embodiment. FIG. 4 shows the wearable halo lighting system 100 in a front underneath view perspective showing the front LED/lens light pod 130, left side sensor/detector module 240, left side light 250, front arm band strap 171, rear arm band strap 172, and an accessories mounting bottom socket 410 of one embodiment.

Figure 5A:
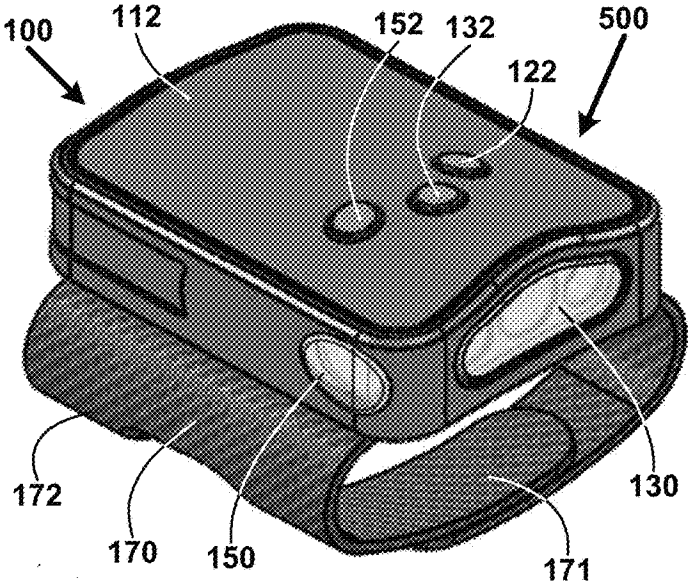
FIG. 5A shows for illustrative purposes an example of a second wearable halo lighting system embodiment right front view perspective of one embodiment.

Second Wearable Halo Lighting System Embodiment:

FIG. 5A shows for illustrative purposes an example of a second wearable halo lighting system embodiment right front view perspective of one embodiment. FIG. 5A shows the wearable halo lighting system 100 in a right front view perspective. The wearable halo lighting system includes a second wearable halo lighting system embodiment 500. The second wearable halo lighting system embodiment 500 embodiment can include at least one component module including the waterproof case, the left side LED/lens light pod control button 122, the front LED/lens light pod 130, the front LED/lens light pod control button 132, the right side LED/lens light pod 150, the right side LED/lens light pod control button 152, and the removable hand band 170 including the front hand band strap 171 and the rear hand band strap 172 of one embodiment.

Figure 5B:
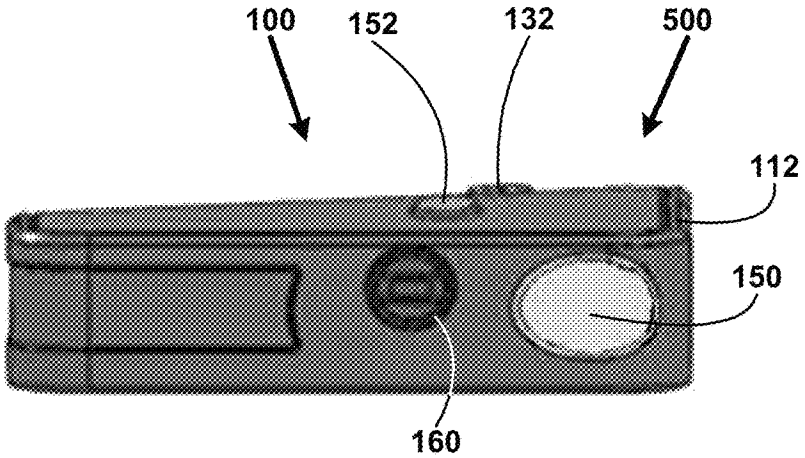
FIG. 5B shows for illustrative purposes an example of a second wearable halo lighting system embodiment right side view perspective of one embodiment.

Second Wearable Halo Lighting System Embodiment Right Side View Perspective:

FIG. 5B shows for illustrative purposes an example of a second wearable halo lighting system embodiment right side view perspective of one embodiment. FIG. 5B shows the wearable halo lighting system 100 in the second wearable halo lighting system embodiment 500. Shown in the second wearable halo lighting system embodiment 500 are the waterproof case 112, the front LED/lens light pod control button 132, the right side LED/lens light pod 150, the right side LED/lens light pod control button 152, and the charger/external battery waterproof connection 160 of one embodiment.

Figure 5C:
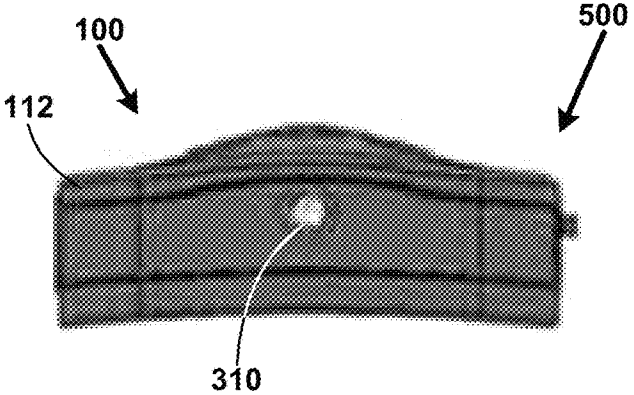
FIG. 5C shows for illustrative purposes an example of a second wearable halo lighting system embodiment rear view perspective of one embodiment.

Second Wearable Halo Lighting System Embodiment Rear View Perspective:

FIG. 5C shows for illustrative purposes an example of a second wearable halo lighting system embodiment rear view perspective of one embodiment. FIG. 5C shows the wearable halo lighting system 100 in the second wearable halo lighting system embodiment 500. Shown in the second wearable halo lighting system embodiment 500 are the waterproof case 112, and the accessories mounting rear socket 310 of one embodiment.

Figure 5D:
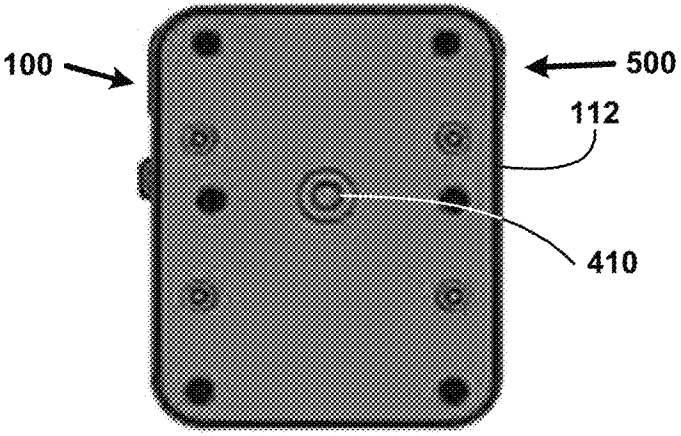
FIG. 5D shows for illustrative purposes an example of a second wearable halo lighting system embodiment underneath view perspective of one embodiment.

Second Wearable Halo Lighting System Embodiment Underneath View Perspective:

FIG. 5D shows for illustrative purposes an example of a second wearable halo lighting system embodiment underneath view perspective of one embodiment. FIG. 5D shows the wearable halo lighting system 100 in the second wearable halo lighting system embodiment 500. Shown in the second wearable halo lighting system embodiment 500 are the waterproof case 112, and the accessories mounting bottom socket 410 of one embodiment.

Figure 6:
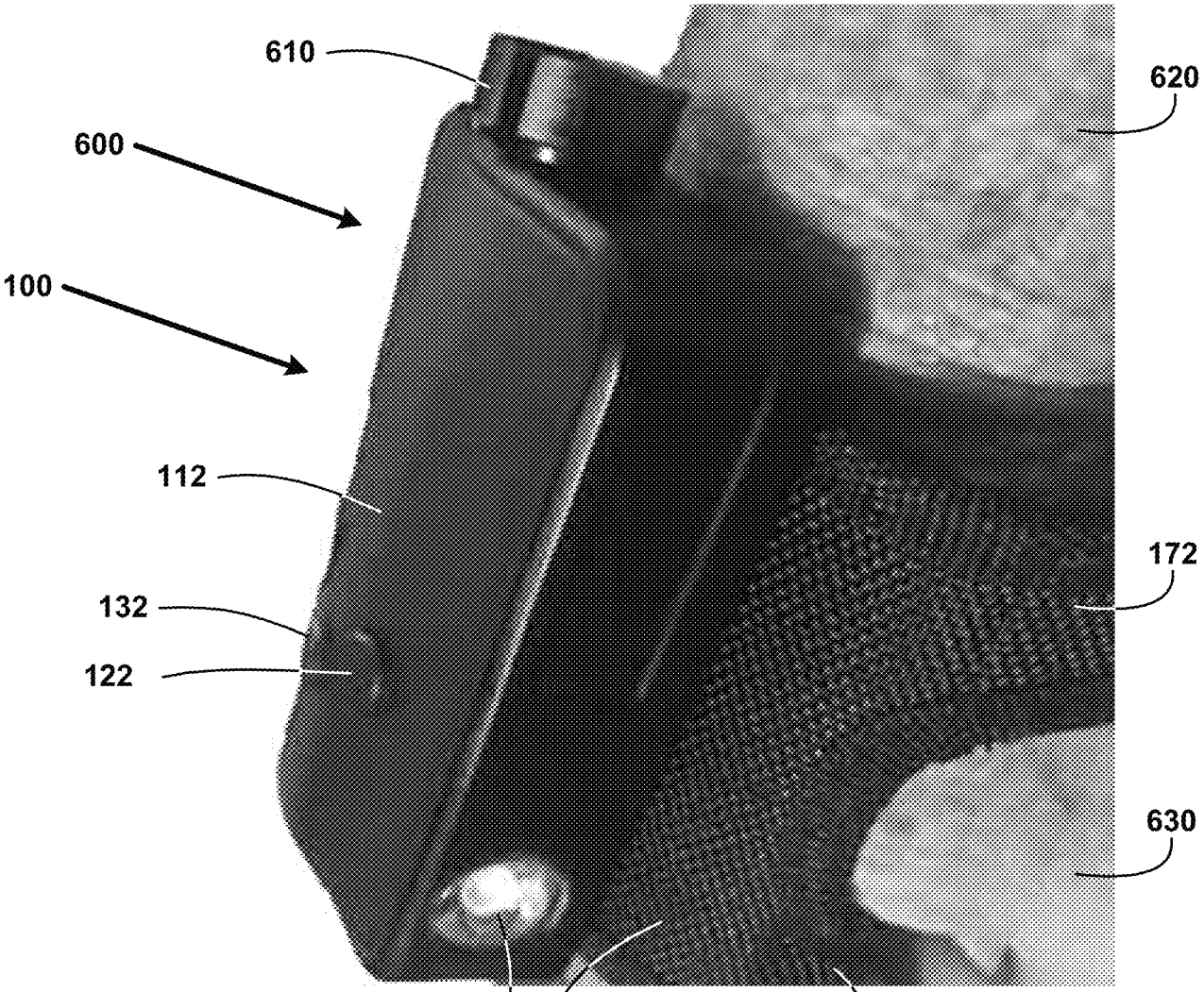
FIG. 6 shows for illustrative purposes an example of a third wearable halo lighting system embodiment view perspective of one embodiment.

Third Wearable Halo Lighting System Embodiment View Perspective:

FIG. 6 shows for illustrative purposes an example of a third wearable halo lighting system embodiment view perspective of one embodiment. FIG. 6 shows the wearable halo lighting system 100 in the third wearable halo lighting system embodiment 600. The third wearable halo lighting system embodiment 600 embodiment can include at least one component module including the waterproof case 112, the left side LED/lens light pod control button 122, the front LED/lens light pod control button 132, and the removable hand band 170 including the front hand band strap 171 and the rear hand band strap 172, and a mode selector knob 610. FIG. 6 shows a user's wrist 620 and thumb 630 wherein the user's thumb is inserted between the front hand band strap 171 and the rear hand band strap 172 of one embodiment.

Figure 7:
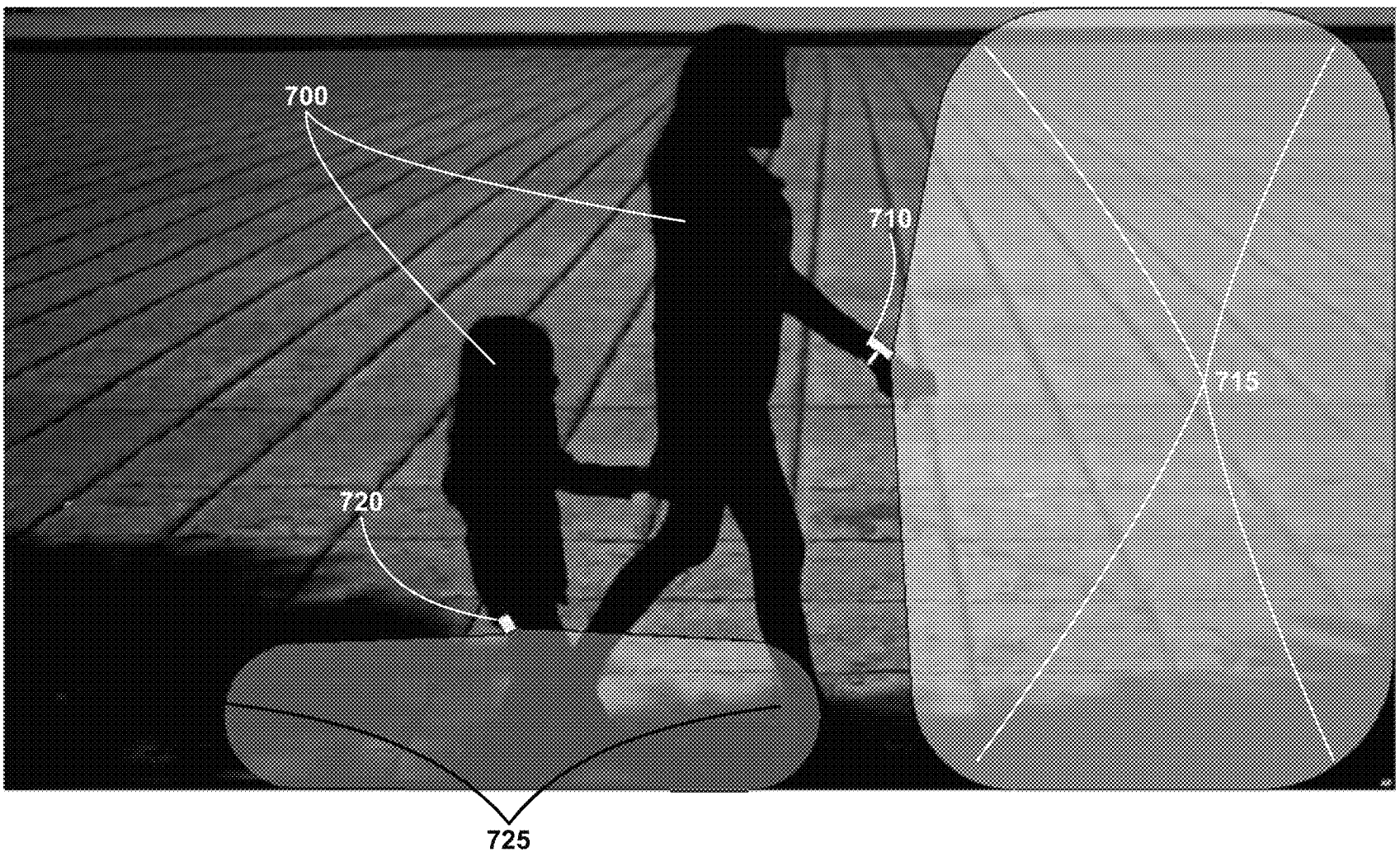
FIG. 7 shows for illustrative purposes an example of a 180 degree halo of light of one embodiment.

A 180 Degree Halo of Light:

FIG. 7 shows for illustrative purposes an example of a 180 degree halo of light of one embodiment. FIG. 7 shows an illustration of two people walking in the dark 700. The taller person is wearing a wearable halo lighting system pointing forward 710. The pointing forward orientation projects a 180 degree halo light bright forward beam with side to side illumination 715, wherein the light pattern resembles a "halo" from which the descriptive name is derived. The shorter person is wearing a wearable halo lighting system hanging at their side in natural arm position 720. The side lens pods project a front to back bright beam illumination 725. The lighting projection provides a user with a broad bright beam side to side and front to back illumination of their path to light their path of one embodiment.

Figure 8A:
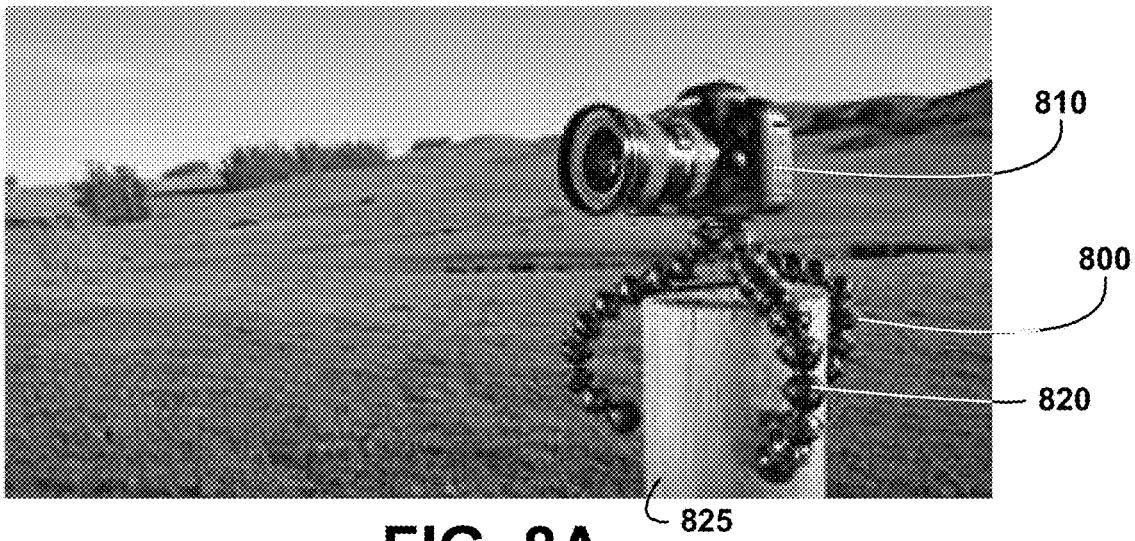
FIG. 8A shows for illustrative purposes an example of a flex arm tripod assembly post top positioning of one embodiment.

A Flex Arm Tripod Assembly Post Top Positioning:

FIG. 8A shows for illustrative purposes an example of a flex arm tripod assembly post top positioning of one embodiment. FIG. 8A shows a flex arm assembly tripod 800. The flex arm assembly tripod 800 includes three segmented flexible link 820 elongated forms joined at the accessories mounting connector. In this illustration the three segmented flexible link 820 elongated forms are positioned wherein a flex arm assembly tripod mounted on post 825 creates a support for a halo lighting system coupled to flex arm assembly tripod 810 of one embodiment.

Figure 8B:
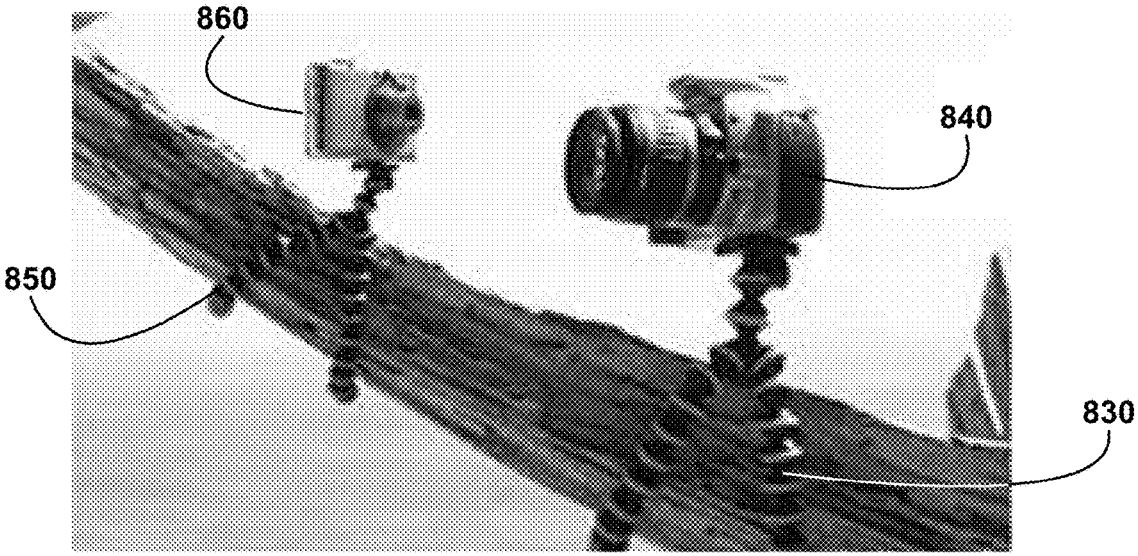
FIG. 8B shows for illustrative purposes an example of a flex arm tripod assembly tree limb positioning of one embodiment.

A Flex Arm Tripod Assembly Tree Limb Positioning:

FIG. 8B shows for illustrative purposes an example of a flex arm tripod assembly tree limb positioning of one embodiment. FIG. 8B shows a halo lighting system coupled to small flex arm assembly tripod 860 and a halo lighting system coupled to large flex arm assembly tripod 840. To support a halo lighting system each flex arm assembly tripod is positioned in a supporting orientation including a small flex arm assembly tripod wrapped on tree limb 850 and a large flex arm assembly tripod wrapped on tree limb 830 of one embodiment.

Figure 9B:
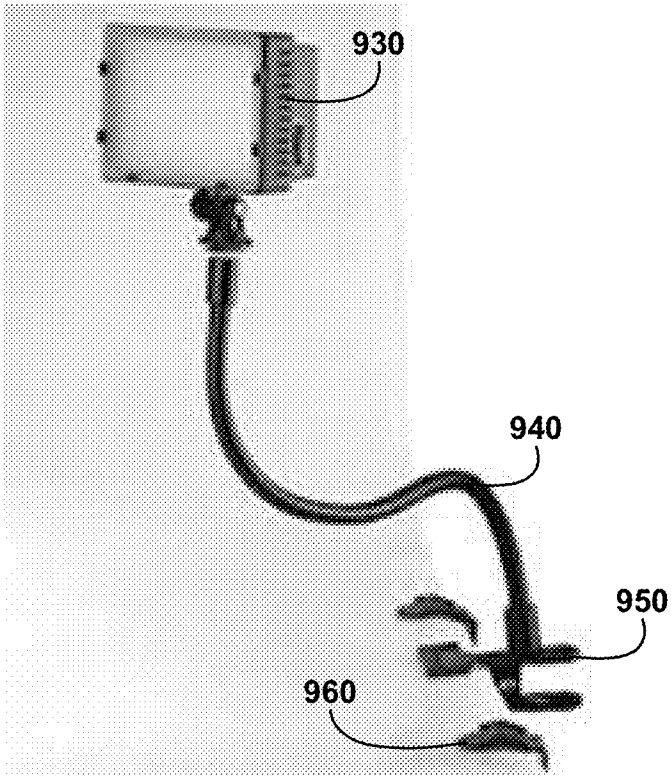
FIG. 9B shows for illustrative purposes an example of a single flex arm clip-on mounting bracket with a halo light diffuser of one embodiment.
Figure 9A:
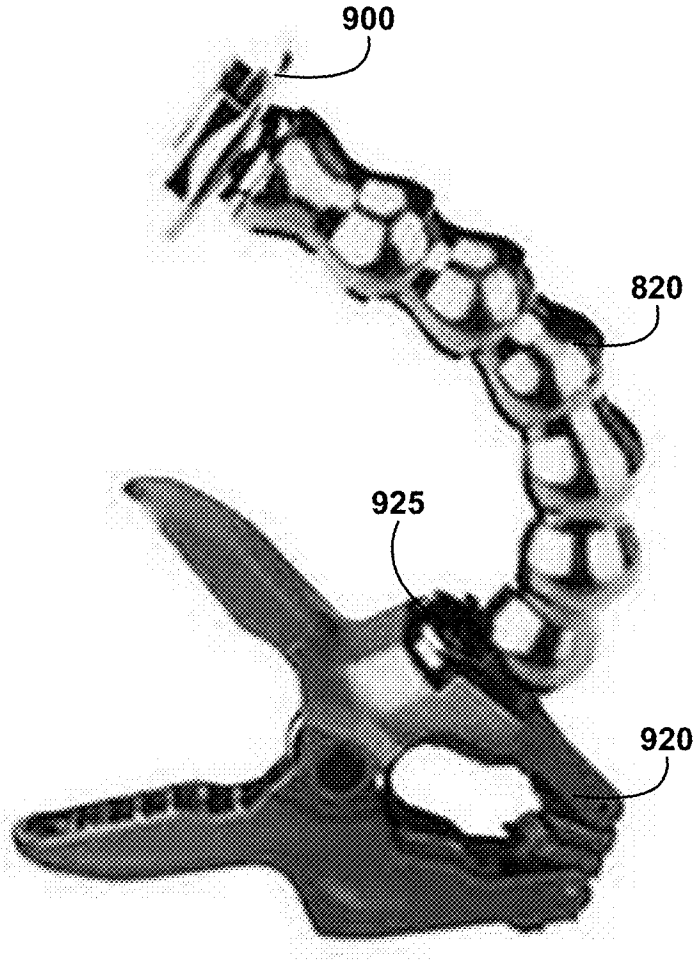
FIG. 9A shows for illustrative purposes an example of a single flex arm clip-on mounting bracket of one embodiment.

A Single Flex Arm Clip-on Mounting Bracket:

FIG. 9A shows for illustrative purposes an example of a single flex arm clip-on mounting bracket of one embodiment. FIG. 9A shows a flex arm clip-on bracket 920, flex arm clip-on bracket insertion coupling 925, the segmented flexible link 820 and flex arm accessories mounting coupling 900. The flex arm clip-on bracket 920 can be used to couple a flex arm clip-on bracket 920 to a shelf or table to support for example a camera or wearable halo lighting system 100 of FIG. 1 of one embodiment.

A Single Flex Arm Clip-on Mounting Bracket with a Halo Light Diffuser:

FIG. 9B shows for illustrative purposes an example of a single flex arm clip-on mounting bracket with a halo light diffuser of one embodiment. FIG. 9B shows a heavy-duty flex arm clip-on bracket 950, an auxiliary flex arm clip-on bracket 960 and a heavy-duty flex arm assembly 940. The heavy-duty flex arm assembly 940 positioned using the heavy-duty flex arm clip-on bracket 950 is supporting a halo lighting system diffuser 930. The halo lighting system diffuser 930 can be coupled to the wearable halo lighting system 100 of FIG. 1 to create a diffused lighting effect for a user desired light level and intensity of one embodiment.

Figure 10:
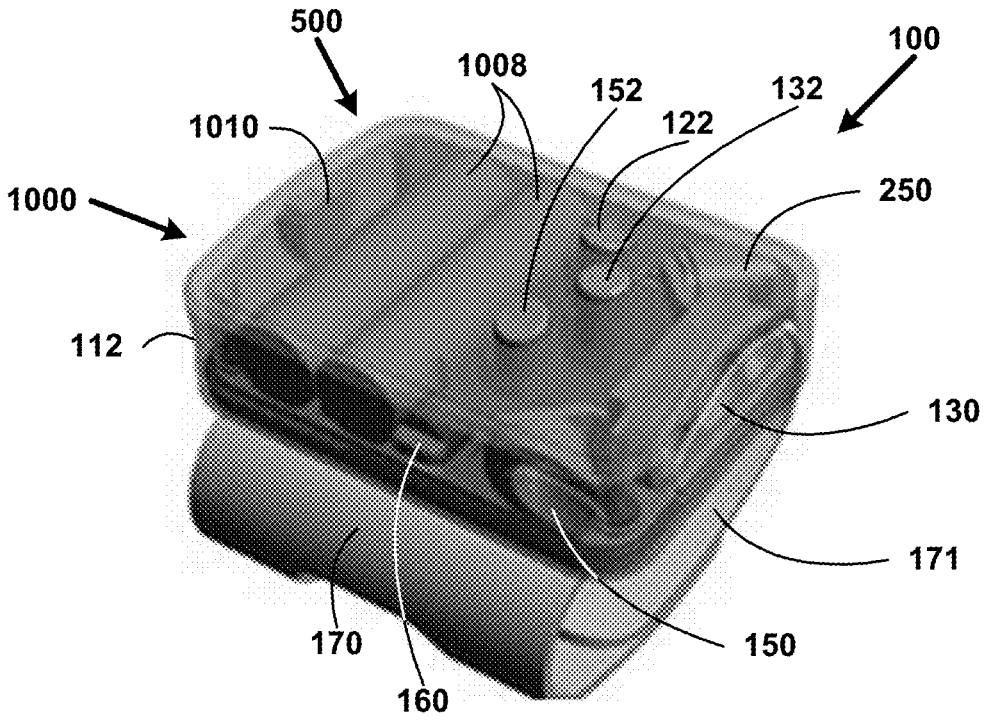
FIG. 10 shows for illustrative purposes an example of a halo lighting system interior layout of one embodiment.

Halo Lighting System Interior Layout:

FIG. 10 shows for illustrative purposes an example of a halo lighting system interior layout of one embodiment. FIG. 10 shows the wearable halo lighting system 100 in the second wearable halo lighting system embodiment 500 with a partially transparent case illustration of a halo lighting system 1000 interior layout including light and lens modules 150 and 250, the left side LED/lens light pod control button 122, the front LED/lens light pod control button 132, a right side LED/lens light pod control button 152, the front LED/lens light pod 130, two batteries 1008, the removable hand band 170, front hand band strap 171, an accessories mounting socket seat 1010, and the charger/external battery waterproof connection 160. The two batteries 1008 can be configured to include for example 18650 batteries (2600 mAh) of one embodiment.

Figure 11A:
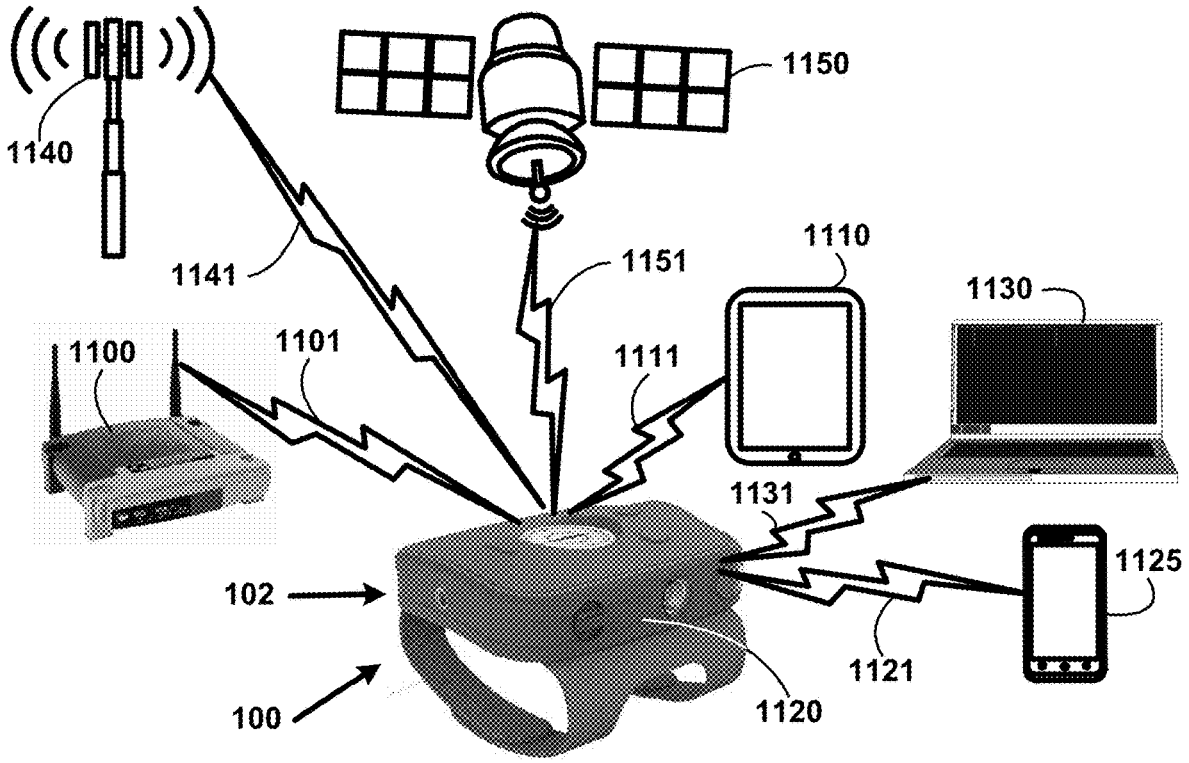
FIG. 11A shows for illustrative purposes an example of halo lighting system WIFI, Bluetooth, cellular and satellite connectivity of one embodiment.

Halo Lighting System WIFI, Bluetooth, Cellular and Satellite Connectivity:

FIG. 11A shows for illustrative purposes an example of halo lighting system WIFI, Bluetooth, cellular and satellite connectivity of one embodiment. FIG. 11A shows the wearable halo lighting system 100 in the first wearable halo lighting system embodiment 102, including a wearable halo lighting system with WIFI, Bluetooth, cellular and satellite integrated connectivity modules 1120. A WIFI router 1100 can be used for WIFI two-way communications with a wearable halo lighting system with WIFI integrated connectivity modules 1101. A user digital tablet 1110 can be used for user digital tablet WIFI two-way communications 1111 with a wearable halo lighting system with WIFI, Bluetooth, cellular and satellite integrated connectivity modules 1120. A user computer 1130 can be used for user computer WIFI two-way communications 1131 with a wearable halo lighting system with WIFI and Bluetooth integrated connectivity modules 1120. A user cell smart phone 1125 can be used wherein a user cell smart phone using a near-field communication connection 1121 to a wearable halo lighting system with WIFI, Bluetooth, cellular and satellite integrated connectivity modules 1120 including a near field transceiver and can include Bluetooth connectivity for additional communications. The wearable halo lighting system with WIFI, Bluetooth, cellular and satellite integrated connectivity modules 1120 can establish communications with a cellular tower 1140 to create cellular two-way communications 1141. The wearable halo lighting system with WIFI, Bluetooth, cellular and satellite integrated connectivity modules 1120 can establish communications with a communications satellite 1150 and establish satellite two-way communications 1151 of one embodiment.

Figure 11B:
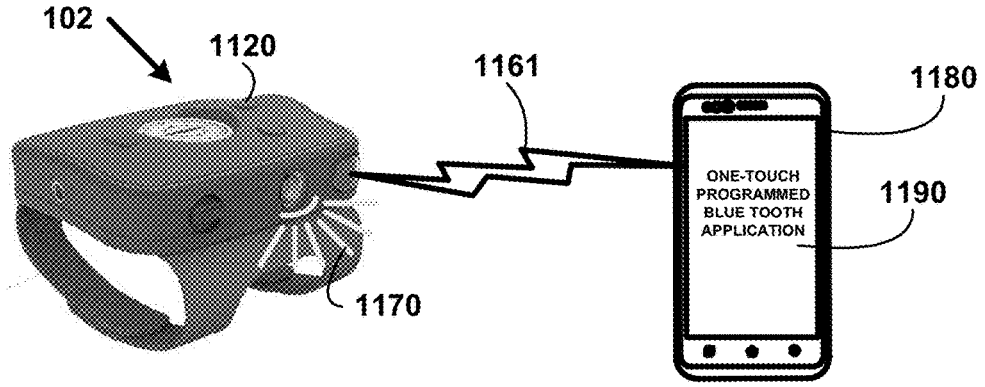
FIG. 11B shows for illustrative purposes an example of a halo lighting system one-touch programmed Bluetooth application of one embodiment.

A Halo Lighting System One-Touch Programmed Bluetooth Application:

FIG. 11B shows for illustrative purposes an example of a halo lighting system one-touch programmed Bluetooth application of one embodiment. FIG. 11B shows a wearable halo lighting system with WIFI, Bluetooth, integrated connectivity modules 1120 and a user cell smart phone with a halo lighting system one-touch programmed Bluetooth application installed 1180. A halo lighting system one-touch programmed Bluetooth application 1190 can be used to perform remote operations instructions to the wearable halo lighting system with WIFI and Bluetooth integrated connectivity modules 1120. A user cell smart phone with a halo lighting system one-touch programmed Bluetooth application installed is shown transmitting operating instructions 1161 to a wearable halo lighting system with an integrated NFC module to turn on a light 1170 per user transmitted halo lighting system one-touch programmed Bluetooth application instructions of one embodiment.

Figure 12A:
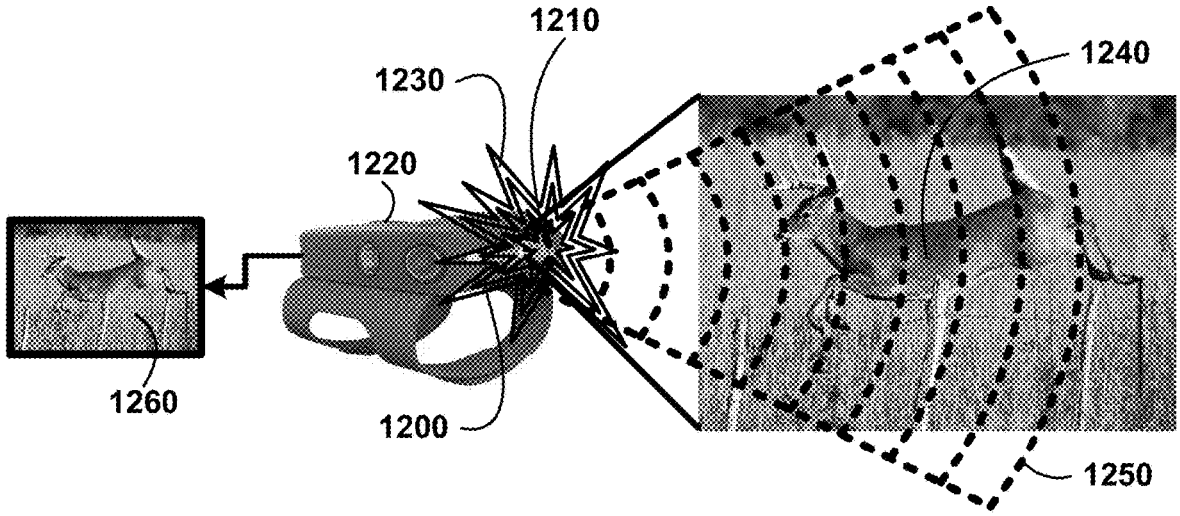
FIG. 12A shows for illustrative purposes an example of a halo lighting system motion sensor automatic camera trigger process of one embodiment.

A Halo Lighting System Motion Sensor Automatic Camera Trigger Process:

FIG. 12A shows for illustrative purposes an example of a halo lighting system motion sensor automatic camera trigger process of one embodiment. FIG. 12A shows a wearable halo lighting system with an integrated motion detector and camera triggering modules 1220. For example a deer jumping a fence in an integrated halo lighting system motion detector module detection range 1240 will activate an integrated halo lighting system motion detector module detection range signal 1250. An integrated halo lighting system motion detector module 1200 will communicate with an integrated halo lighting system camera module 1210. An integrated halo lighting system camera module with camera and flash triggered by an integrated motion detector 1230 will cause a photo to be snapped by the camera. A digital photo of a deer jumping a fence captured by a motion detector triggered camera operation 1260 can be captured and stored as a still picture or video as controlled by the user in a settings control panel. This provides the user with a useful tool to observe, obtain confirmation and/or be alerted to a person, animal or object in their proximity or remotely using the halo lighting system one-touch programmed Bluetooth application installed 1190 of FIG. 11B of one embodiment.

Figure 12B:
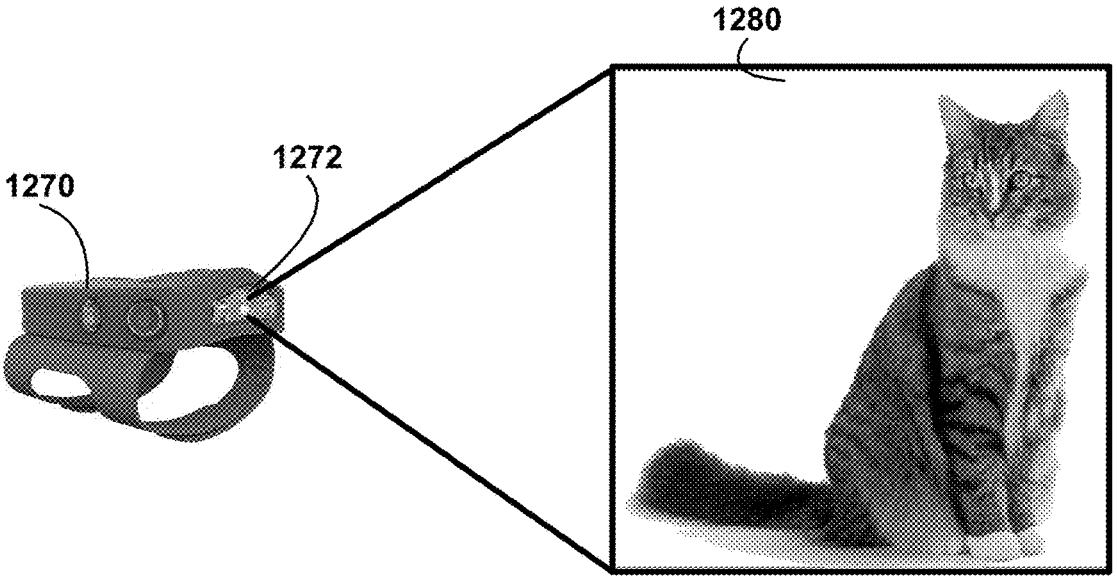
FIG. 12B shows for illustrative purposes an example a halo lighting system camera process of one embodiment.

A Halo Lighting System Camera Process:

FIG. 12B shows for illustrative purposes an example of a halo lighting system camera process of one embodiment. FIG. 12B shows a wearable halo lighting system with an integrated camera module 1270. An integrated wearable halo lighting system camera module 1272 can be used for a user taking a photo of a cat 1280 for example of one embodiment.

Figure 13A:
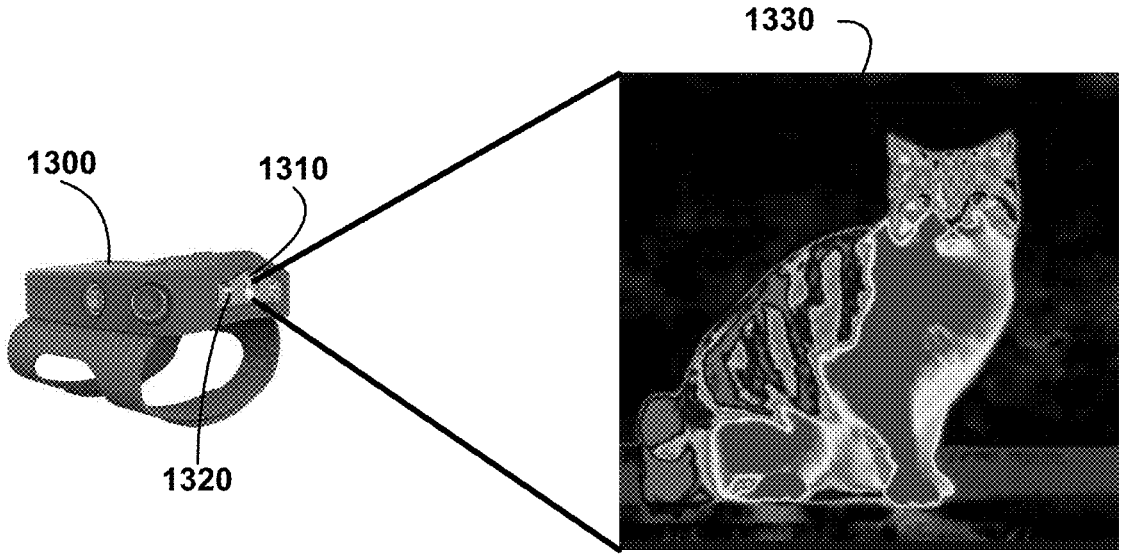
FIG. 13A shows for illustrative purposes an example of a halo lighting system infrared light and camera process of one embodiment.

A Halo Lighting System Infrared Light and Camera Process:

FIG. 13A shows for illustrative purposes an example of a halo lighting system infrared light and camera process of one embodiment. FIG. 13A shows a wearable halo lighting system with integrated infrared camera and infrared light emitter modules 1300. An integrated infrared camera module 1310 and an integrated infrared light emitter module 1320 can be used by a user to capture an infrared photo by a user using the wearable halo lighting system with integrated infrared camera and infrared light emitter modules 1330 in darkness and low light conditions as shown in this illustration for example an infrared photo of a cat of one embodiment.

Figure 13B:
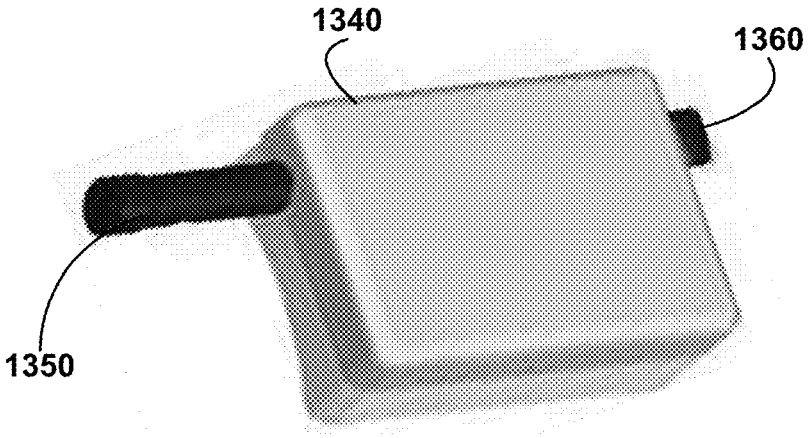
FIG. 13B shows for illustrative purposes an example of a halo lighting system wearable external battery pack of one embodiment.

A Halo Lighting System Wearable External Battery Pack:

FIG. 13B shows for illustrative purposes an example of a halo lighting system wearable external battery pack of one embodiment. FIG. 13B shows a halo lighting system wearable external battery pack 1340. The halo lighting system wearable external battery pack 1340 includes a power connector cable 1350 to connect to additional external battery packs. The halo lighting system wearable external battery pack 1500 includes a connection outlet 1360 used to connect to the wearable halo lighting system 100 of FIG. 1. A user can wear an embodiment of the halo lighting system wearable external battery pack 1340 on their person, attached to gear or carried in for example a backpack to provide additional battery power to the wearable halo lighting system 100 of FIG. 1 and accessories of one embodiment.

Figure 14:
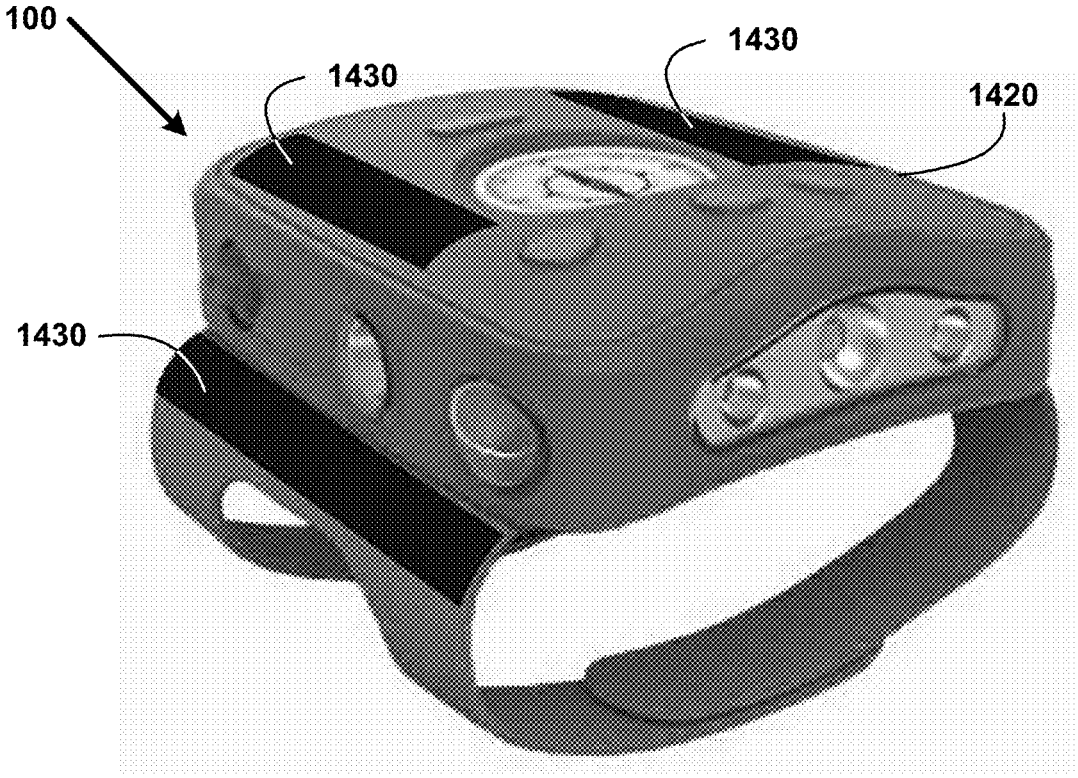
FIG. 14 shows for illustrative purposes an example of a halo lighting system integrated solar cell charging modules of one embodiment.

A Halo Lighting System Integrated Solar Cell Charging Modules:

FIG. 14 shows for illustrative purposes an example of a halo lighting system integrated solar cell charging modules of one embodiment. FIG. 14 shows a wearable halo lighting system 100 of FIG. 1 with integrated solar cell battery charging modules 1420. Integrated solar cell battery charging modules 1430 provides the user with battery charging using sunlight while for example away from other sources of charging power including on a body of water in a boat and camping in wildness areas.

Figure 15:
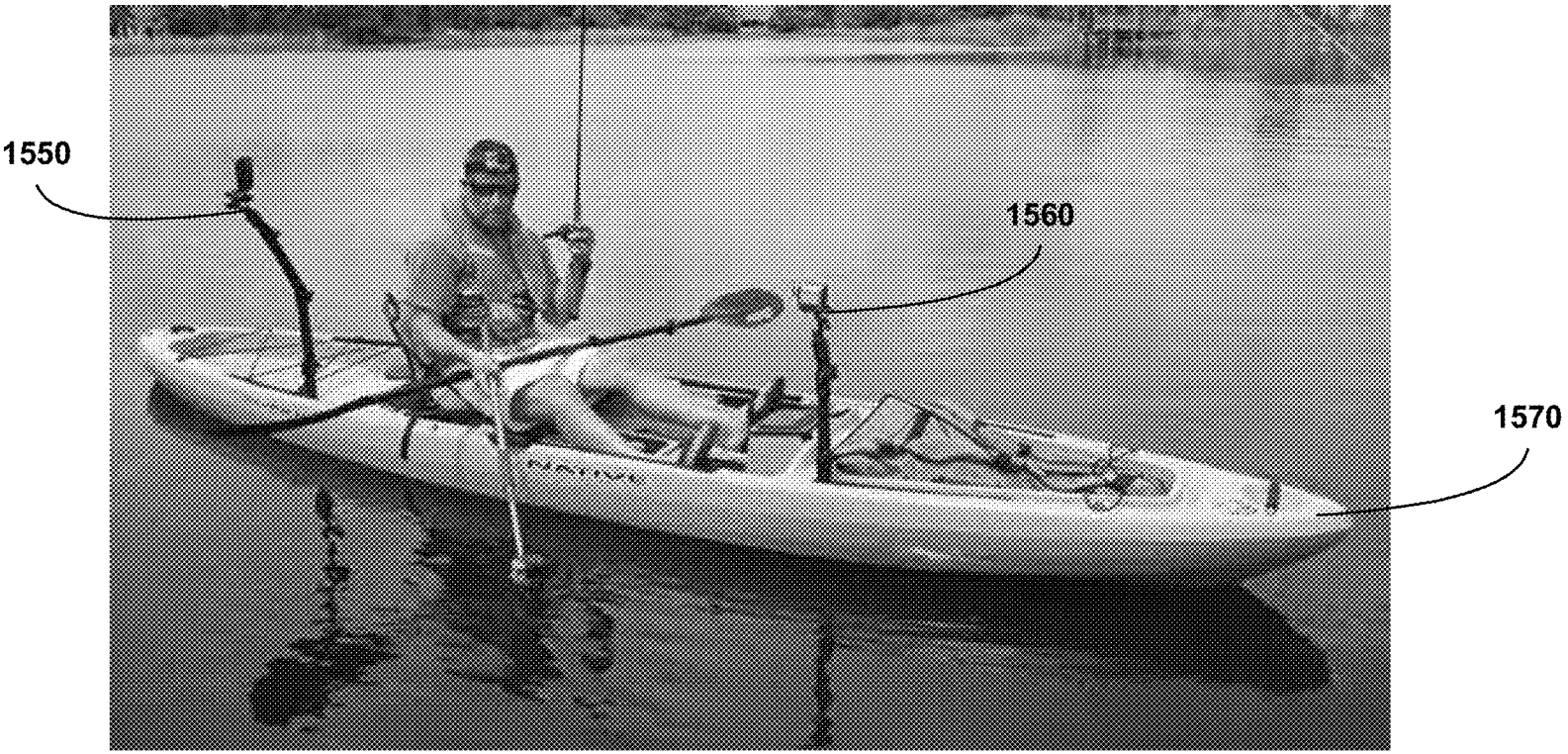
FIG. 15 shows for illustrative purposes an example of a rugged shock resistant mounting system boating application of one embodiment.

A Rugged Shock Resistant Mounting System Boating Application:

FIG. 15 shows for illustrative purposes an example of a rugged shock resistant mounting system boating application of one embodiment. FIG. 15 shows a halo lighting system anchor/navigation light mounting rod assembly 1560 mounted on a kayak 1570 and multiple flex arm assemblies coupled and mounted on a kayak 1550. A user in a kayak 1570 can then operate remotely the supported a wearable halo lighting system 100 of FIG. 1 or other supported halo accessory using the halo lighting system one-touch programmed Bluetooth application 1190 of FIG. 11B of one embodiment.

Figure 16:
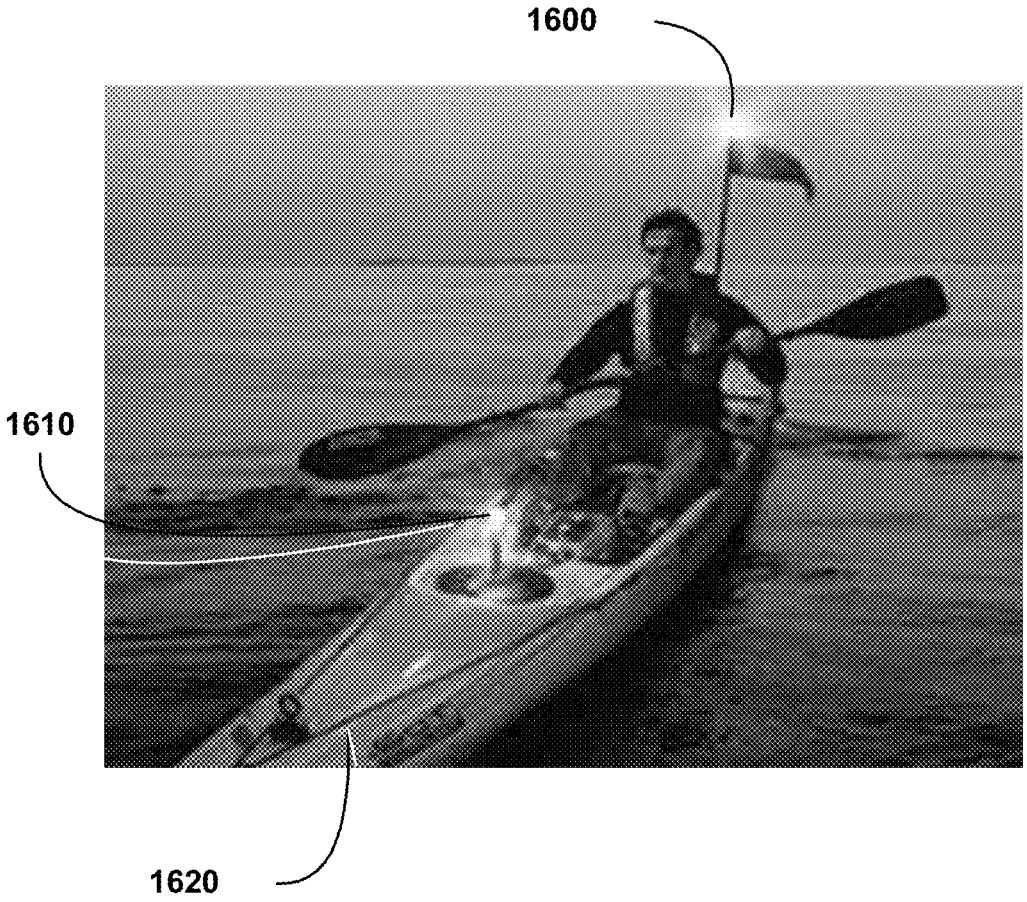
FIG. 16 shows for illustrative purposes an example of a dual anchor/navigation light mounting of one embodiment.

A Dual Anchor/Navigation Light Mounting:

FIG. 16 shows for illustrative purposes an example of a dual anchor/navigation light mounting of one embodiment. FIG. 16 shows a halo lighting system anchor/navigation light mounted near the front of a kayak 1570 and a halo lighting system anchor/navigation light mounted on the stern flag mast of a kayak 1600. The dual mounting of the 360 degree anchor/navigation light and fixture 1610 forward and aft of the kayak 1570 provides partial navigation lighting which can be supplemented with includes with the wearable halo lighting system 100 of FIG. 1 wherein red and green side lights can be installed for port and starboard lighting to provide full navigational lighting for the safety of the user and others of one embodiment.

Figure 17:
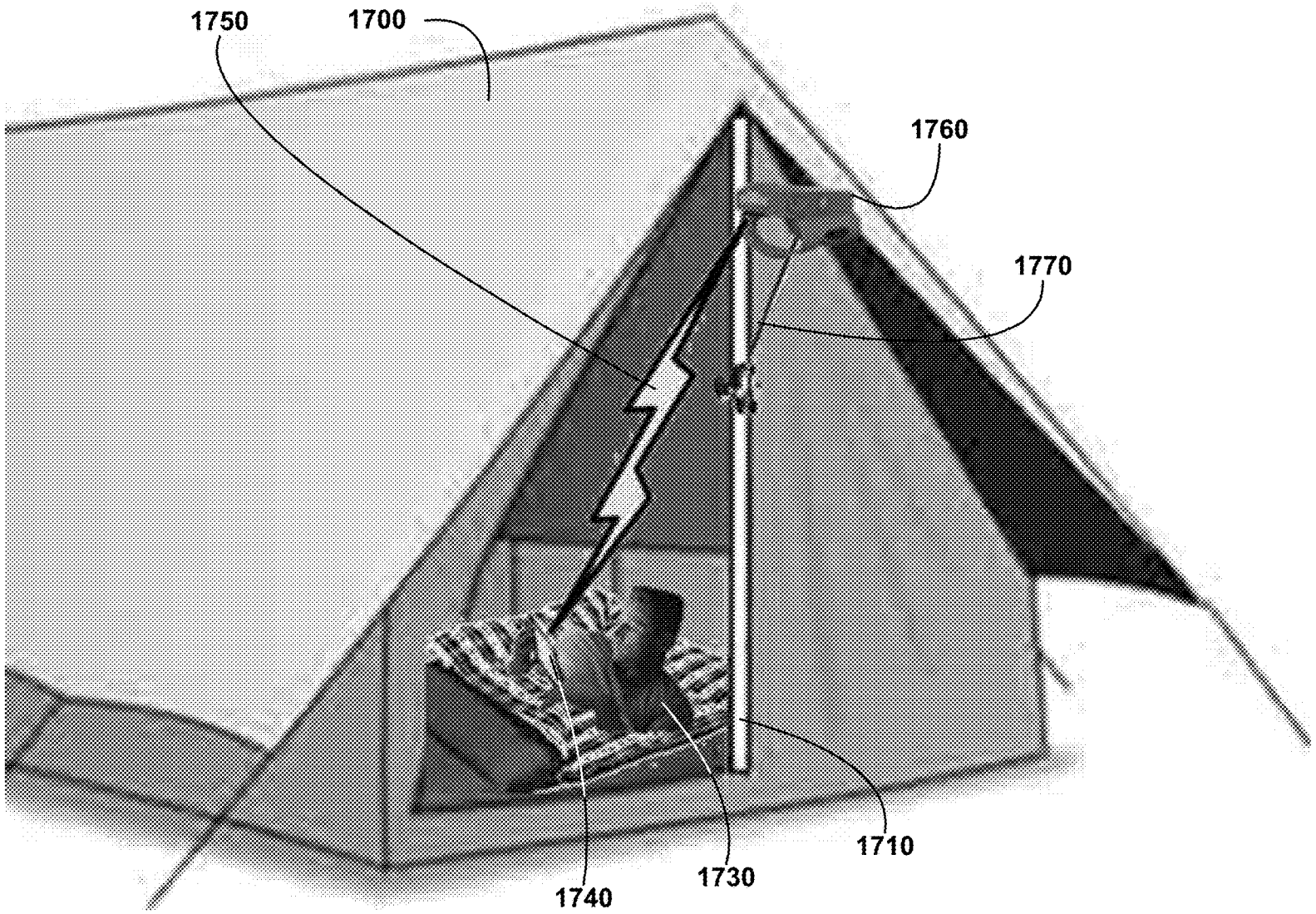
FIG. 17 shows for illustrative purposes an example of a halo lighting system remote-control on/off and brightness camping application of one embodiment.

A Halo Lighting System Remote-Control on/Off and Brightness Camping Application:

FIG. 17 shows for illustrative purposes an example of a halo lighting system remote-control on/off and brightness camping application of one embodiment. FIG. 17 shows a camping tent 1700, a tent pole 1710, a user laying in a sleeping bag 1730, a user digital tablet 1740, a mounting rod 1770 coupled to the tent pole 1710 and a wearable halo lighting system coupled to a mounting rod 1760. In this camping example a user triggering the wearable halo lighting system on/off brightness control via the integrated NFC for a remote operation using the without having to leave the sleeping bag using the one-touch programmed Bluetooth application installed on the user digital tablet 1750 of one embodiment.

One embodiment discloses a method including creating a halo lighting system including at least one component module including LED/lens light pod modules for projecting at least a 180 degree halo of light, wherein halo lighting system devices can include a wearable halo lighting device, at least one wearable external battery pack, a halo anchor/navigation light device projecting a 360 degree lighting pattern, creating a shock resistant waterproof halo lighting system case and component modules, wherein halo lighting system are configured to include support couple connection devices for coupling the halo lighting system to fixed and flexible support devices, creating a halo lighting system one-touch programmed Bluetooth application for performing remote operations of the wearable halo lighting device and all wearable halo lighting device modules, and, wherein halo lighting system devices are configured to include a waterproof and shock resistant case, a motion detector, a photo detector sensor, a camera, an infrared camera, an infrared emitting light, WIFI, Bluetooth, cellular and satellite connectivity modules.

Creating the wearable halo lighting device is configured to include modules including at least one integrated compass, a left, front and right LED/lens light pod module including LED lights and lens, a left, front and right LED/lens light pod control button with brightness controls and independent strobe mode selectors, direction adjustable LED light output ports, multiple beam angles including 0, 45, 90, 180, 225 degrees, a removable hand band, a rear and bottom accessories mounting socket, integrated solar cell battery charging modules and a two-way USB input or output plug connection, wherein the wearable halo lighting device is configured for using to a depth of 300 feet in water. Creating the wearable external battery pack can be configured to include a plurality of battery modules configured to all be connected together and configured to include at least one power connection outlet including a USB plug connection. Creating the halo lighting system can be configured for multiple applications on land and on the surface and below water to a depth of 300 feet.

Creating halo lighting system can be configured to include physical support coupling connection devices for coupling the halo lighting system to a fixed or flexible support device. Creating the halo lighting system is configured to include automatic light dim/turn off controls, a power management system configured to include a battery meter that can be monitored remotely, power bank function module, individual light dial brightness and strobe pod control, individual power controls and auto heat dimming, a gas release valve, a clip on diffuser with light filters, alternate colored lenses, an integral heat sink, remote controls with panic, motion sensor, one-touch On, GPS, emergency SMS, blinking light signaling output, and an emergency locator transmitter. Creating a halo lighting system one-touch programmed Bluetooth application for operating remotely the operations of the halo lighting system devices is configured for performing remote operations of the power management system functions. Creating a halo lighting system one-touch programmed Bluetooth application for operating remotely the halo lighting system devices is configured for remotely operating all LED/lens light pod device modules. Creating a halo lighting system one-touch programmed Bluetooth application for operating remotely the halo lighting system devices is configured for remotely operating integrated modules including a motion detector, a camera, an infrared camera, and an infrared emitting light including LEDs. Creating a halo lighting system one-touch programmed Bluetooth application for remote operations of the halo lighting system devices is configured for remotely operating WIFI, Bluetooth, cellular and satellite connectivity modules.

Another embodiment discloses an apparatus including a halo lighting system with at least one component module including halo lighting system LED/lens light pod devices for projecting at least a 180 degree halo of light, a wearable halo lighting device, a wearable external battery pack, a halo anchor/navigation light device projecting a 360 degree lighting pattern, at least one rugged shock resistant waterproof halo lighting system case and at least one support coupling connector wherein the halo lighting system devices can be mounted to fixed and flexible support devices, a halo lighting system one-touch programmed Bluetooth application for performing remote operations of the wearable halo lighting device functions, and, wherein halo lighting system devices are configured to include at least one module including multiple positioned light bulbs and lens, a photo detector sensor, a motion detector, a camera, an infrared camera, an infrared emitting light, WIFI, Bluetooth, cellular and satellite connectivity modules.

The at least one rugged shock resistant waterproof case can be coupled to a support device including a spear gun, a flexible arm assembly, helmet, bike, tent, tree, or table and a fixed support using the at least one support coupling connector. The halo anchor/navigation light device projecting a 360 degree lighting pattern can be configured for multiple applications on land and water. The wearable external battery pack can be configured for a plurality of battery modules, and wherein a plurality of battery pack modules can all be connected together and include at least one power connection outlet including a USB plug connection. The wearable halo lighting device is configured to include modules including at least one integrated compass, a left side, front and right side LED/lens light pod including bulbs and lens, a left side, front and right side LED/lens light pod control button with brightness controls and independent strobe mode selectors, individual light control buttons with brightness controls and independent strobe mode selectors, direction adjustable LED light output ports, multiple beam angles including 0, 45, 90, 180, 225 degrees, front and back arm band straps, a rear and bottom accessories mounting socket, integrated solar cell battery charging modules and a two-way USB input or output plug connection.

In yet another embodiment it discloses an apparatus including a wearable halo lighting device with LED/lens light pods for projecting at least a 180 degree halo of light, at least one wearable external battery pack for providing power to the wearable halo lighting device, a halo anchor/navigation light device for projecting a 360 degree lighting pattern, at least one rugged shock resistant halo lighting system supporting accessory for mounting wearable halo lighting system devices and fixed halo lighting system devices, a halo lighting system one-touch programmed Bluetooth application to remotely operate the wearable halo lighting device and all integrated wearable halo lighting device modules, and, wherein halo lighting system devices are configured to include at least one module including light bulbs and lens, a motion detector, a photo detector sensor, a camera, an infrared camera, an infrared emitting light, accessories mounting sockets, and WIFI, Bluetooth, cellular and satellite connectivity modules.

The wearable halo lighting device can be configured to include modules including at least one integrated compass, a left side, front and right side LED/lens light pod including bulbs and lens, a left side, front and right side LED/lens light pod control button with brightness controls and independent strobe mode selectors, direction adjustable LED light output ports, multiple beam angles including 0, 45, 90, 180, 225 degrees, front and back arm bands, a rear and bottom accessories mounting socket, a motion detector, a camera, an infrared camera, an infrared emitting light including LEDs, WIFI, Bluetooth, cellular and satellite connectivity modules, integrated solar cell battery charging modules and a two-way USB input or output plug connection, wherein the wearable halo lighting device is configured for projecting a 180 degree halo lighting pattern illumination from front to back and side to side. The wearable halo lighting device is configured to include at least one support coupling connector used to couple the wearable halo lighting device to a support device including a spear gun, a flexible arm assembly, helmet, bike, tent, tree, or table and a fixed support. The wearable external battery pack can be configured for a plurality of battery modules and wherein a plurality of battery pack modules can all be connected together and include at least one power connection outlet including a USB plug connection. The halo lighting system one-touch programmed Bluetooth application can be configured to be installed on a user smart phone, a user digital tablet, a user computer and establish connectivity with a WIFI router.

The foregoing has described the principles, embodiments and modes of operation of the embodiments. However, the embodiments should not be construed as being limited to the particular embodiments discussed. The above described embodiments should be regarded as illustrative rather than restrictive, and it should be appreciated that variations may be made in those embodiments by workers skilled in the art without departing from the scope of the present invention as defined by the following claims.

What is claimed is:

1. A method, comprising:

creating a lighting system configured to include a plurality of LED/lens light pod modules including multiple beam angles including 0, 45, 90, 180, 225 and 360 degrees with direction adjustable LED ports;

wherein the lighting system is configured to include at least one feature including a plurality of sensors and detectors configured for automatically activating at least one feature including the plurality of LED/lens light pod modules for projecting light in at least one of the multiple beam angles;

wherein the lighting system is configured for at least one user body wearing mounting including mounting on a user's arm; and wherein the lighting system is configured for at least one mounting parameter configured for including mounting on a flexible support and mounting on a fixed mounting support.

2. The method of claim 1, further comprising using at least one sensor to automatically activate a front LED/lens light pod module when the user raises and points a hand to gain a predetermined distance forward focused beam in a pointing direction, wherein the at least one sensor activates left and right side LED/lens light pod modules for projecting a light pattern to a front and rear direction when the user's arm is at one's side.

3. The method of claim 1, wherein the plurality of LED/lens light pod modules are configured for using at least one LED/lens light pod module including a left side, front and right side LED/lens light pod module including LED lights and lens, control buttons, brightness controls and independent strobe mode selectors.

4. The method of claim 1, wherein the lighting system is configured for using at least one external battery pack configured to include a plurality of battery modules and wherein the at least one external battery pack is configured for powering the plurality of LED/lens light pod modules and the at least one feature.

5. The method of claim 1, further comprising the lighting system is configured for using a one-touch programmed wireless application for performing remote operations of the lighting system including operations of a motion detector, a photo detector sensor, a camera, an infrared camera, an infrared emitting light, WIFI, Bluetooth, cellular and satellite connectivity modules.

6. The method of claim 1, further comprising the lighting system is configured for using automatic light dim/turn off controls, a power management system configured to include a battery meter that can be monitored remotely, power bank function module, individual light dial brightness and strobe pod control, individual power controls and auto heat dimming, a gas release valve, a clip on diffuser with light filters, alternate colored lenses, an integral heat sink, remote controls with panic, motion sensor, one-touch On, GPS, emergency SMS, blinking light signaling output, and an emergency locator transmitter.

7. The method of claim 1, further comprising the lighting system multiple mounting parameter is configured for multiple applications on land and water including using at least one support module configured for mounting to at least one pulpit rail, track and other vessel structures, spear gun, flexible arm assembly, helmet, bike, tent, tree, table and a fixed support using at least one support coupling connector.

8. The method of claim 1, further comprising the lighting system configured for using WIFI, Bluetooth, cellular and satellite connectivity modules for establishing connectivity with WIFI, Bluetooth, cellular and satellite systems using a one-touch programmed Bluetooth application installed on a user smart phone, a user digital tablet, a user computer.

9. The method of claim 1, further comprising the lighting system configured for using an accessories mounting socket, a motion detector, a camera, an infrared camera, an infrared emitting light including LEDs, integrated solar cell battery charging modules and a two-way USB input or output plug connection.

10. The method of claim 1, further comprising the LED/lens light pod module is configured to include a left side, front and right side LED/lens light pod module including bulbs and lens, a left side, front and right side control buttons with brightness controls and independent strobe mode selectors.

11. An apparatus, comprising:

a lighting system configured to include a plurality of LED/lens light pod modules including multiple beam angles including 0, 45, 90, 180, 225 and 360 degrees with direction adjustable LED ports;

wherein the lighting system is configured to include at least one feature including a plurality of sensors and detectors configured for automatically activating at least one feature including the plurality of LED/lens light pod modules for projecting light in at least one of the multiple beam angles;

wherein the lighting system is configured to include at least one user body wearing mounting including mounting on a user's arm; and wherein the lighting system is configured to include at least one mounting parameter configured for including mounting on a flexible support and mounting on a fixed mounting support.

12. The apparatus of claim 11, further comprising the lighting system at least one sensor is configured to automatically activate a front LED/lens light pod module when the user raises and points a hand to gain a predetermined distance forward focused beam in a pointing direction, and wherein at least one sensor activates left and right side LED/lens light pod modules for projecting a light pattern to a front and rear direction when the user's arm is at one's side.

13. The apparatus of claim 11, further comprising the lighting system at least one feature is configured to include automatic light dim/turn off controls, a power management system configured to include a battery meter that can be monitored remotely, power bank function module, individual light dial brightness and independent strobe mode selectors, individual power controls and auto heat dimming, a gas release valve, a clip on diffuser with light filters, alternate colored lenses, an integral heat sink, remote controls with panic, motion sensor, one-touch On, GPS, emergency SMS, blinking light signaling output, and an emergency locator transmitter.

14. The apparatus of claim 11, further comprising the lighting system at least one feature is configured to include a motion detector, a camera, an infrared camera, and an infrared emitting light including LEDs.

15. The apparatus of claim 11, further the lighting system at least one multiple mounting parameter is configured for multiple applications on land and water including using at least one support module configured for mounting to at least one pulpit rail, track and other vessel structures, spear gun, flexible arm assembly, helmet, bike, tent, tree, table and a fixed support using at least one support coupling connector.

16. An apparatus, comprising:

a portable lighting device configured to include a plurality of features for projecting light;

at least one feature configured to project light in at least one of multiple beam angles;

a plurality of LED/lens light pod modules configured to include multiple beam angles including 0, 45, 90, 180, 225 and 360 degrees with direction adjustable LED ports;

at least one feature configured to include a plurality of sensors and detectors configured to automatically activate at least one feature including at least one of the plurality of LED/lens light pod modules;

wherein the portable lighting device is configured to include at least one user wearable body mounting including mounting on a user's arm; and wherein the portable lighting device is configured to include at least one mounting parameter configured for including mounting on a flexible support and mounting on a fixed mounting support.

17. The apparatus of claim 16, further comprising the portable lighting device at least one sensor configured to automatically activate a front LED/lens light pod module when a user raises and points a hand to gain a predetermined distance forward focused beam in a pointing direction.

18. The apparatus of claim 16, further comprising the portable lighting device at least one sensor configured to activate a left and a right side LED/lens light pod module for projecting a light pattern to a front and rear direction when the user's arm is at one's side.

19. The apparatus of claim 16, further comprising the portable lighting device at least one feature configured to include a one-touch programmed wireless application to perform remote operations of the portable lighting device.

20. The apparatus of claim 16, further comprising the portable lighting device at least one feature configured to include a shock resistant case, a motion detector, a photo detector sensor, a camera, an infrared camera, an infrared emitting light, WIFI, Bluetooth, cellular and satellite connectivity modules.

* * * * *